US006035872A

United States Patent [19]

Hees et al.

[11] Patent Number: 6,035,872

[45] Date of Patent: Mar. 14, 2000

[54] ROTARY DISTRIBUTOR ROTATING APPARATUS FOR HANDLING OF OBJECTS, IN PARTICULAR CONTAINERS, WITH A REVOLVING JOINT FOR THE TRANSPORT OF FLUID BETWEEN A STATIONARY ASSEMBLY AND A ROTATING ASSEMBLY

[75] Inventors: Hans Werner Hees, Oberwiesen; Michael Schmidt, Wiesbaden, both of Germany

[73] Assignee: Hans Werner Hees, Oberwiesen, Germany

[21] Appl. No.: 09/076,645

[22] Filed: May 12, 1998

Related U.S. Application Data

[63] Continuation-in-part of application No. PCT/EP96/04976, Nov. 13, 1996.

[30] Foreign Application Priority Data

Nov. 14, 1995 [DE] Germany ..... 195 42 432
Oct. 31, 1996 [DE] Germany ..... 296 18 998 U

[51] Int. Cl.[7] ..... B08B 3/02

[52] U.S. Cl. ..... 134/167 R; 134/180; 141/89; 141/91; 239/264

[58] Field of Search ..... 134/104.1, 145, 134/167 R, 168 R, 180, 181, 176, 179; 141/89, 90, 91; 239/261, 264

[56] References Cited

U.S. PATENT DOCUMENTS

| | | | |
|---|---|---|---|
| 2,992,781 | 7/1961 | Howard | 134/179 X |
| 3,370,869 | 2/1968 | Dutcher | 134/176 X |
| 4,414,036 | 11/1983 | Anderson et al. | 134/23 |
| 4,559,961 | 12/1985 | Anderson et al. | 141/91 X |
| 4,642,971 | 2/1987 | Gilkey | 141/89 X |
| 5,458,166 | 10/1995 | Kronseder | 141/91 X |

FOREIGN PATENT DOCUMENTS

| | | | |
|---|---|---|---|
| 2009238 | 10/1971 | European Pat. Off. . | |
| 0051890 | 5/1982 | European Pat. Off. . | |
| 0408851 | 1/1991 | European Pat. Off. . | |
| 1380105 | 10/1964 | France | 134/179 |
| 2739742 | 3/1979 | Germany . | |
| 234455 | 11/1925 | United Kingdom | 134/176 |
| 1354514 | 5/1974 | United Kingdom | 134/179 |

*Primary Examiner*—Philip R. Coe
*Attorney, Agent, or Firm*—Baker Botts L.L.P.

[57] ABSTRACT

The invention concerns a rotating apparatus (1) for the handling of objects, in particular containers (20), for example for the filling of the containers. The rotating apparatus comprises a stationary assembly (10) and a rotating assembly (14) which is rotatable with respect to the stationary assembly (10) and is driven by a rotary drive. According to the invention there is provided on the rotating assembly (14) at least one discharge opening (46) for the discharge of a cleaning fluid for cleaning a shielding wall (22) being stationary during the rotational operation of the rotating assembly and optionally for cleaning other stationary components (30). The at least one discharge opening (46) is connected to a stationary cleaning fluid supply via a revolving joint (42). For the revolving joint it is proposed that the revolving joint comprises a revolving joint stationary unit fixed or fixable to the stationary assembly (10) and a revolving joint rotating unit connectable or connected to the rotating assembly (14) for common rotation. The two rotating joint components are rotatably supported at each other by axially directed sliding surfaces.

50 Claims, 7 Drawing Sheets a)

b)

ROTARY DISTRIBUTOR ROTATING APPARATUS FOR HANDLING OF OBJECTS, IN PARTICULAR CONTAINERS, WITH A REVOLVING JOINT FOR THE TRANSPORT OF FLUID BETWEEN A STATIONARY ASSEMBLY AND A ROTATING ASSEMBLY

This is a continuation-in-part of copending application Ser. No. PCT/EP96/04976, filed Nov. 13, 1996.

DESCRIPTION

The present invention concerns a rotating apparatus for handling of objects, in particular of containers such as bottles, in particular for at least one of cleaning and filling and closing and labelling and singling and sorting and aligning the containers or objects, comprising a stationary assembly, a rotating assembly driven by a rotary drive and rotatable with respect to the stationary assembly, receptacles for the objects and associated to the circumference of said rotating assembly, handling devices for the handling of the objects and a shielding wall which at least partially encloses the rotating assembly and which is stationary during driving the rotating assembly for rotation.

For such rotating apparatus it is often necessary to regularly clean the inner side of the shielding wall which is directed towards the rotating assembly. The shielding wall can be a protecting wall which shall give protection against touching of the rotating element, the handling devices or other components, which shall protect against noise (acoustic protection), which shall give sight protection or which shall protect against contamination. In case of protection against contamination it is possible, for example, that the rotating assembly or the handling devices are protected against contamination from the outside, for example, if the rotating apparatus is placed in a dusty atmosphere or it is possible that the surrounding of the rotating apparatus is protected against contamination which is caused by the handling of the objects. As an example reference is made to a rotating apparatus in the form of a filling apparatus for bottles, in which bottles are filled with a filling medium, for example a beverage. During the filling it can happen that certain amounts of the filling medium are splattered or splashed during the bottling. The shielding wall prevents the surrounding of the filling apparatus for bottles from being contaminated by the filling medium.

In conventional rotating apparatus of the mentioned type the shielding wall and possibly other stationary components so far were cleaned manually, for example by hosing down with a hose provided that the shielding wall has corresponding openings or encloses the rotating assembly only partially. For particularly high requirements with respect to the cleanness, or if no cleaning openings are provided in a shielding wall which completely encloses the rotating assembly one could dismantle the shielding wall at least partially to allow cleaning of the shielding wall and possibly the other stationary components.

In particular recently there have been increased efforts to increase the productivity. Before this background the ways of cleaning as described are no longer satisfactory for beverage filling apparatus as well as generally for rotating apparatus for handling of objects. In the special case of beverage filling apparatus one can foresee that at least in the long run the cleaning possibilities as described will not be sufficient any more because of the hygienic standards which will increase significantly in the future.

In view of the foregoing it is an object of the invention to provide a rotating apparatus of the kind mentioned which allows a simple and reliable cleaning of the shielding wall from the inside and possibly of other stationary components of the apparatus. For solving this object it is suggested that there is arranged at least one discharge opening at the rotating assembly for discharge of a cleaning fluid, in particular a cleaning liquid, for cleaning of said shielding wall and possibly of other stationary components of the apparatus, and that said at least one discharge opening is connected with a stationary cleaning fluid supply via a revolving joint.

Because there is provided at least one discharge opening, preferrably several discharge openings, on the rotating assembly, the shielding wall can be cleaned simply and reliably from the inside. To this end the cleaning fluid, in particular the cleaning liquid, is supplied to the at least one discharge opening via the revolving joint and is directed against the inner surface of the shielding wall and possibly onto the other stationary components. While doing so, the rotating assembly can be rotated so that the cleaning medium reaches the complete inner surface of the shielding wall and all other stationary components to be cleaned. The rotating assembly can rotate continuously during the cleaning operation or can also be stopped at certain rotary positions, for example for the cleaning of heavily soiled regions of the shielding wall or for the cleaning of heavily soiled stationary components. Preferably, the discharge openings are formed as nozzles which direct a cleaning fluid jet onto the shielding wall or the other components to be cleaned. To this end, the cleaning fluid can be supplied to the nozzles with a pressure which is substantially higher than normal pressure, so that a high pressure cleaning effect is achieved as in the case of a high pressure cleaning device. If the cleaning fluid is steam, for example, a steam jet cleaning effect results like the effect achieved with a steam jet cleaning device.

Besides water, possibly with cleaning additives, also special liquid cleaning chemicals are a possibility to be used as cleaning liquids. It is clear that after the application of a special liquid cleaning chemical one can subsequently clean with water in a final cleaning step, if necessary, to remove the residues of the cleaning chemical.

In all cases the cleaning can be effected substantially mechanized without the need to remove the shielding wall or parts of the shielding wall. There is further no need for the shielding wall to have openings for cleaning purposes, since a manual cleaning by means of hosing with a hose or the like can be left out. Additionally to the at least one discharge opening arranged on the rotating assembly, there can be provided one or several stationary discharge openings for example on the shielding wall which allow a mechanized cleaning of the rotating assembly.

The invention is particularly advantageous in the case of a beverage filling apparatus, since highest hygienic standards can be fulfilled if the invention is applied. Beverage which sticks to the inner surface of the shielding wall or to other stationary components and which is possibly dried can be reliably removed. For the removal special cleaning chemicals or also steam can be used. If steam is used, also a heat sterilization effect is achieved besides the cleaning effect.

The invention offers the possibility that cleaning operation phases are effected automatically in certain time intervals. Normally, for the cleaning the working operation of the rotating apparatus, in particular the filling operation of the beverage filling apparatus, will be interrupted for the respective cleaning operation phase. However, it cannot be ruled out that for special applications the working operation of the rotating apparatus will be continued during the respective cleaning operation phase.

As can be seen from the foregoing remarks, the invention cannot only be suitably applied to beverage filling apparatus or bottling apparatus. The rotating apparatus, as has already been mentioned in the introduction, can also be an apparatus for at least one of singling, sorting and aligning of objects, for example containers such as bottles, or also of lids for the closing of containers. For example, these objects (containers or lids) can be supplied to the rotating apparatus in groups comprising a plurality of objects with the objects being disordered within the groups. The objects will then be singled, possibly sorted or sorted out and possibly aligned within the rotating apparatus. One has also to consider other applications, in particular in the production and processing technology, for example automatic milling machines, automatic turning machines, automatic drilling machines, other automatic forming machines and the like.

With respect to the construction of the revolving joint it is suggested that the revolving joint comprises a revolving joint stationary unit which is fixed or fixable to the stationary assembly to prevent rotation, and a revolving joint rotating unit which is connectable or connected with the rotating assembly for rotating together, wherein these two revolving joint components are rotatably supported at each other by axially directed sliding surfaces.

Sliding surfaces which are axially directed can be processed relatively easily and, with respect to sliding surfaces which are radially directed, less severe manufacturing tolerances are possible. It is even preferred that the two revolving joint components have radial play with respect to each other. In this case, the revolving joint can be manufactured very economically, since only relatively rough manufacturing tolerances with respect to the radial dimensions must be fulfilled. Also with respect to the mounting of the revolving joint on the rotating apparatus there are high cost advantages, since also for this mounting there are no particularly high tolerances which have to be met. For example, by means of the radial play a certain deviation between the rotary axis of the revolving joint rotating unit and the rotary axis of the rotating assembly can be accommodated. It is not necessary that the two rotary axes are completely coaxial with respect to each other. It is sufficient if the two axes are substantially parallel with respect to each other and have such distance from each other that this distance can be accommodated by the radial play. This viewpoint is of importance in particular when the revolving joint is replaced or when the revolving joint together with the at least one discharge opening (on corresponding pipelines or the like) is retrofitted on a conventional rotating apparatus.

For the sealing of the revolving joint separate sealing lips, sealing rings or the like may be provided in particular neighboring to the sealing surfaces. However, not only because of the costs it is particularly advantageous if the sliding surfaces are simultaneously formed as sealing surfaces. Sealing elements such as sealing lips, sealing rings and the like are usually manufactured from materials which are softer and less abrasion-proof than usual materials of sliding surfaces. Such sealing elements may accordingly wear with time and then they have to be replaced. The sliding surfaces which, according to the preferred embodiment, are simultaneously designed as sealing surfaces may be of such nature that they have sufficient sealing effect for the complete service life of the rotating apparatus, so that a reduced effort for maintenance and servicing results.

There may be provided setting means which are mounted on at least one of the two revolving joint components and which are axially effective and adapted to hold the two revolving joint components in sealing abutment with respect to each other. The setting means may be provided to compensate for a certain abrasion on the sealing surfaces so that despite the abrasion the sealing effect is maintained. The setting means may, however, also be provided, so that the two revolving joint components need not be permanently maintained in sealing abutment with respect to each other. The latter design is preferred in the case that the cleaning of the shielding wall and possibly the other stationary components is effected only phase-wise, i.e. not permanently during the working operation of the rotating apparatus. Since the revolving joint rotating unit rotates together with the rotating assembly during working operation, the sliding surfaces and possibly the whole revolving joint maybe heated up because of the friction which occurs between the sliding surfaces. Such a heating up may in particular happen in the case when the sliding surfaces are maintained in sealing abutment with respect to each other.

During a cleaning operation phase an excessive warming up or heating up of the sliding surfaces or the whole revolving joint is prevented because the heat generated by friction will be transported away by the cleaning fluid (provided the fluid flow is greater than a certain minimal fluid flow). During a pure working operation without simultaneous cleaning operation phase such a removal of friction heat by the cleaning fluid is not possible. If the sliding surfaces are not in sealing abutment during the pure working operation, the friction between the sliding surfaces is reduced or possibly substantially cancelled, so that there develops only minor or virtually no friction heat. Then there is no danger that during pure working operation the sliding surfaces or the revolving joint may overheat and possibly be damaged thereby.

One of the two revolving joint components may be formed with sliding surfaces facing each other and the respective other of the two revolving joint components may be formed with sliding surfaces turned away from each other. Preferably, the two revolving joint components together form a ring chamber for the fluid distribution, i.e. for the distribution of the cleaning fluid with the ring chamber being sealed or being sealable particularly in the region of the sliding surfaces. By the provision of the ring chamber, a uniform fluid distribution with pressure conditions which substantially remain constant, is possible. The ring chamber may also be intended to mix within the ring chamber several fluids supplied to the ring chamber via corresponding supply openings so that a fluid mixture emerges from the ring chamber via one or several corresponding discharge openings.

One of the two revolving joint components may form an annular groove which is radially open and in which the respective other revolving joint component is received with its sliding surfaces. In this case the revolving joint may be manufactured relatively simply and economically and the manufacturing costs of the whole rotating apparatus as well are thus correspondingly reduced. The fact that the revolving joint can be manufactured at a reasonable price is of importance particularly in the case of revolving joints intended for retrofitting since in this case the persons deciding over the retrofitting may be convinced more easily that a retrofitting is worthwhile.

The ring chamber may be limited radially between a bottom of the annular groove of said one revolving joint component and a circumferential surface of said other revolving joint component. The annular groove may be open radially inwardly or outwardly. If there is sufficient space available in radial direction, the variant with the annular groove which is radially outwardly open is preferred. In this case the revolving joint may be mounted particularly easily and there can be conduits or the like for the supply or withdrawal of fluid which extend radially outwardly from the revolving joint component received with its sliding surfaces within the annular groove.

Said one revolving joint component may comprise two partial components which are combined in a dividing plane disposed between its two sliding surfaces facing each other. In this case, the two revolving joint components can be assembled easily to form the revolving joint. In particular, the revolving joint component which has to be received with its sliding surfaces in the annular groove can be inserted between the two partial components like a sandwich.

At least one of the two sliding surfaces facing each other may be arranged on a flange of said one revolving joint component which flange is movable axially. Preferably this flange is exposed to the influence of setting means which are axially effective and disposed on said one revolving joint component. The results are the advantages which were already mentioned in connection with the setting means, with the embodiment set forth now can be realized without large constructive and manufacturing expenditure. It is of major advantage if the setting means which are axially effective are formed by an inflating tube which is supported or supportable on a supporting surface of said one revolving joint component which supporting surface is neighboring to the flange. By use of an inflating tube as setting means, an uniform exerting of force onto the flange is possible over the hole length of the flexible tube in case of an inflated tube. Preferably the inflating tube is ring-shaped, i.e. formed as an annular tube, so that the sliding surfaces may be uniformly loaded for the sealing abutment over the hole respective annular surface.

Because of its simple construction, setting means in the form of an inflating tube result also in a particularly high reliability (safety against failure, low susceptibility to be in need of repairs) and the constructive and manufacturing expenditure is extremely low, so that there are major cost advantages with respect to other setting means, such as setting motors or the like. The inflating tube can be inflated by means of a gas, in particular by means of air or also by means of a suitable liquid for the exerting of pressure onto the sliding surfaces via the flange.

The inflating tube may be received in an annular groove of a supporting plate of said one revolving joint component which plate abuts against the flange. The manufacturing expenditure for such an annular groove is low. The supporting plate may be connected sandwich-like with said one revolving joint component by tension rods, for example screws, wherein in the case of the division of said one revolving joint component in partial components these tension rods—if desired—also hold these partial components together.

One revolving joint component of the two revolving joint components may be manufactured from metal, in particular stainless steel, and the other revolving joint component may be manufactured from plastic. For the manufacture of the revolving joint component made of plastic, one may use polyethylen in particular. However, also other plastics materials are a possibility.

In case of construction of said one revolving joint component with a flange which is axially movable, this revolving joint component is preferably manufactured from plastic and—if desired—is constructed with at least one weakening recess which favors the axial deflectability of the flange. The respective revolving joint component may be manufactured easily in this case and, in case of a resilient plastic, the flange is resilient to either exert a desired pressing force onto the sliding surfaces or—in the case of setting means, in particular of the inflating tube (when the flexible tube is not inflated)—to provide a restoring force which is adapted to relieve the sliding surfaces. By means of corresponding dimensioning of said at least one weakening recess, the force exerted to the sliding surfaces or the restoring force, respectively, may be adjusted. In the latter case it is possible that the setting means may only nead to apply a relatively weak force for the movement of the flange.

The revolving joint stationary unit may be mounted on the shielding wall or also on a separate support setup on which the shielding wall possibly is fastened. Preferably, at least one entrainment means of the rotating assembly is provided for the driving of the revolving joint rotating unit. The entrainment means may engage directly with the revolving joint rotating unit or also with a fluid transport pipe or the like which is fixed at the revolving joint rotating unit and possibly is connected with the ring chamber.

As already mentioned above, the sliding surfaces may be arranged opposite each other substantially without sealing force during working operation of the rotating apparatus and are adapted to be sealingly pressed against each other for cleaning operation phases. If during the working operation of the rotating apparatus there is no simultaneous cleaning, i.e. if there occurs a "dry operation" of the revolving joint, a detrimental warming up or heating up of the sliding surfaces or the revolving joint because of friction head is avoided.

The revolving joint stationary unit may be formed U-shaped with a radially outwardly open annular groove in a cross section containing the axis, the revolving joint rotating unit preferably being formed as a ring body which is received in the groove and has a radial fluid connection.

The revolving joint may be formed annular and—if desired—may enclose a part of the rotating assembly. In case that the rotating assembly is, for example, a filling apparatus for the filling of containers, in particular a beverage filling apparatus, the filling medium (in particular the beverage) can be supplied to the rotating assembly via conventional rotary distributors having an axial supply of filling medium, whereas the cleaning fluid is supplied to the rotating assembly non-axially. The terms "axial" and "non-axial" refer to the rotational axes of the rotating assembly and the revolving joint rotating unit which substantially coincide or are neighboring closely. Axial supply means that the filling medium is substantially supplied along the rotational axis of the rotating assembly and non-axial supply means that the fluid is not supplied along the rotational axis to the rotary distributor. By means of the annular construction of the revolving joint, many conventional rotating apparatus may be retrofitted with the revolving joint and a corresponding conduit system having at least one discharge opening.

There may be provided holding means for the objects, in particular containers, on the rotating assembly. The handling devices may be arranged stationary or may be connected with the rotating assembly for common rotation. The shielding wall may have passing-through openings for object conveying means, in particular container conveying means, which supply objects, in particular the containers, to the rotating assembly or remove the same from the rotating assembly. Preferably, the revolving joint is disposed in an upper region of the rotating assembly or above the same.

As has already been indicated in the foregoing discussion, the rotating apparatus may have a conduit system comprising the at least one discharge opening. At least one of the conduit system having the at least one discharge opening and the revolving joint may be adapted for retrofitting to the rotating apparatus which is substantially ready for operation. Accordingly, conventional rotating apparatus may be retrofitted or changed over to a rotating apparatus according to the present invention.

According to another aspect, the invention concerns a revolving joint for the transport of fluid between a stationary assembly and a rotating assembly, in particular in a rotating apparatus as described in the foregoing. The revolving joint comprises a revolving joint stationary unit which is fixed or fixable to the stationary assembly to prevent rotation, and a revolving joint rotating unit which is connectable or connected with the rotating assembly for rotating together, wherein these two revolving joint components are rotatably supported at each other by axially directed sliding surfaces. The revolving joint further may have at least one further feature of the revolving joint of a rotating apparatus according to the invention as described in the foregoing.

In particular, it is pointed to the construction of the revolving joint having radial play between the revolving joint stationary unit and the revolving joint rotating unit, the annular construction of the revolving joint as well as the possibility that the sliding surfaces may be formed as sealing surfaces, with the sliding surfaces possibly not permanently being held in sealing abutment against each other. The advantages explained above are achieved.

The invention will be explained in more detail in the following with reference to an embodiment shown in FIGS. 1 to 5.

The bottling apparatus 1 for example for the bottling of beverages which is shown in the figures comprises a stationary assembly 10 being of the type of a base cabinet and a rotating assembly 14 which is rotatably supported with respect to the stationary assembly 10. The rotating assembly is substantially supported in overhung position or is supported in the stationary assembly 10 and at a support assembly 12. The support assembly comprises vertical beams 12*a* extending in vertical direction from the upper surface of the stationary assembly 10 and being fastened on the same and horizontal beams 12*b* which are fastened to the upper ends of the vertical beams 12*a* and extend above the rotating assembly 14. Accordingly, the rotating assembly is disposed between the stationary assembly 10 and the horizontal beams 12*b*.

Figure 1:
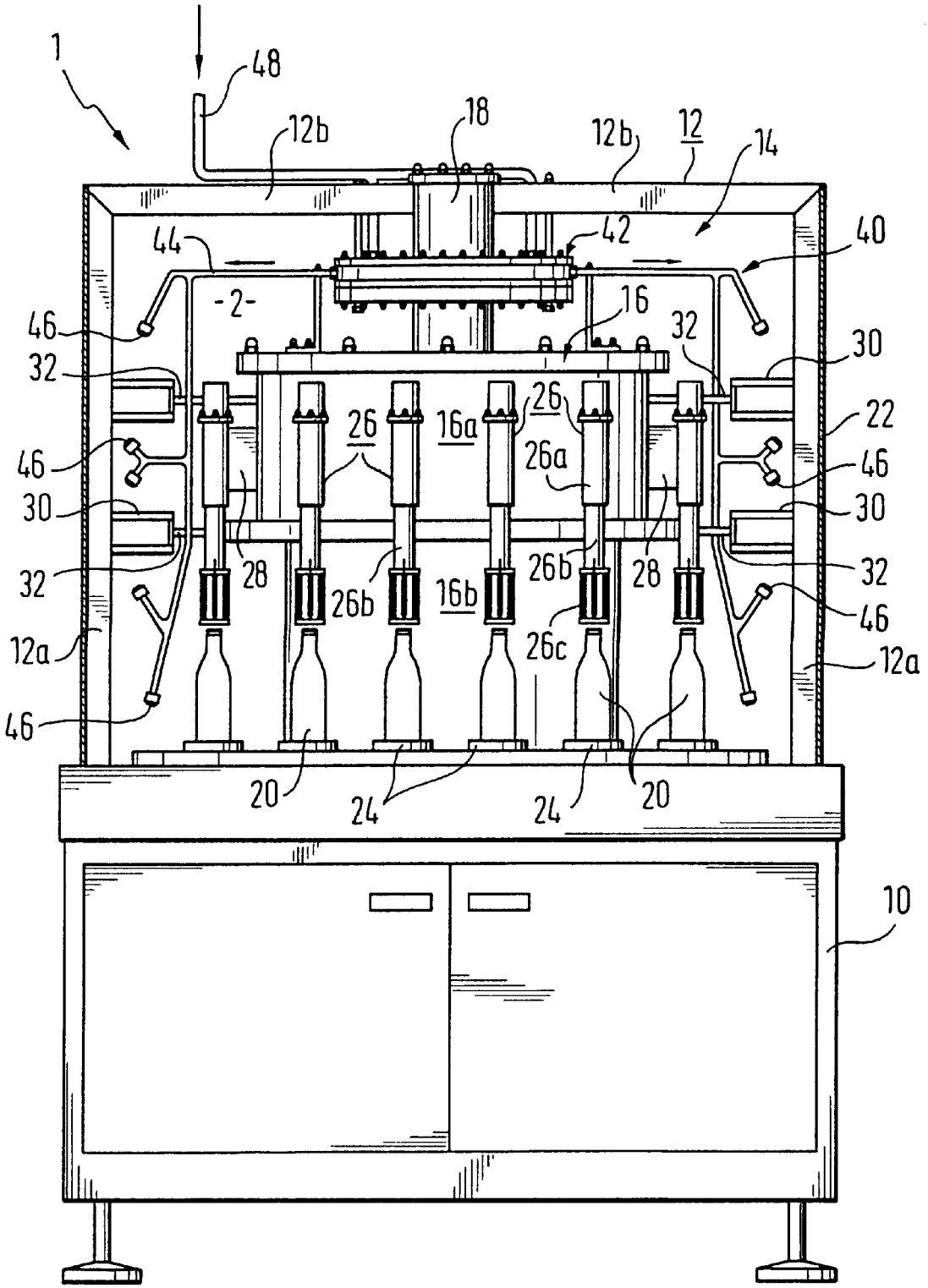
FIG. 1 shows an embodiment of a rotating apparatus according to the invention in the form of a bottling apparatus in a view from the side with the shielding wall being depicted sectionally.
Figure 3:
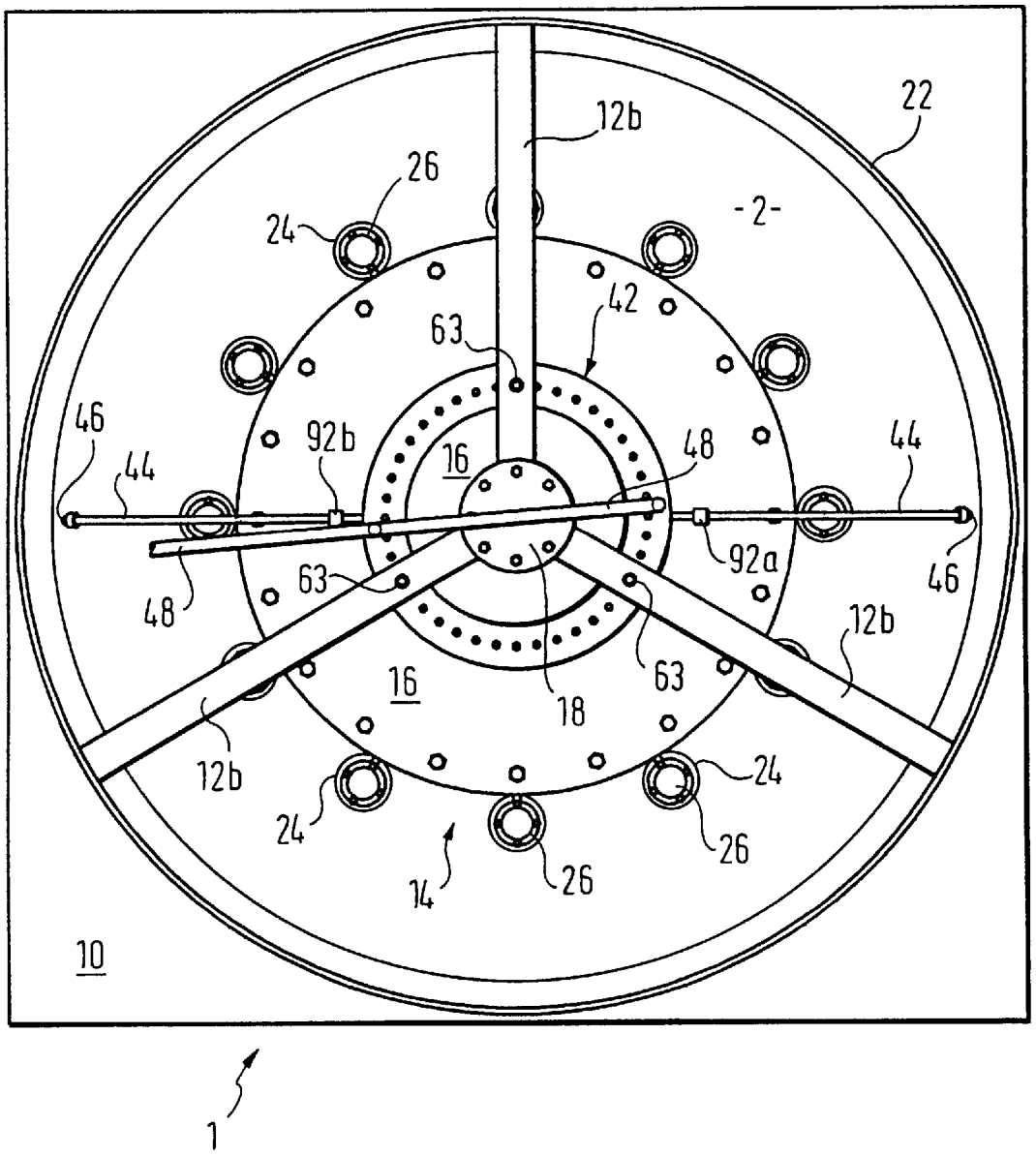
FIG. 3 shows a top view onto or a view into the bottling apparatus being open upwardly.

With respect to the structure of the support assembly different variants are conceivable with FIG. 1 and FIG. 3 showing variants differing slightly from each other. According to the embodiment of FIG. 3, there are provided three horizontal beams 12*b* and correspondingly three vertical beams 12*a* with two neighboring horizontal beams enclosing an angle of about 120° between them. Further deviations between FIG. 1 and FIG. 3 are due to the fact that in FIG. 3 not all of the components shown in FIG. 1 are depicted and that the figures concern embodiments which differ slightly from each other. For the explanation of the invention, these deviations are without any relevance so that these deviations need not be considered in the following.

The rotating assembly 14 has a conveying and bottling rotating unit 16 which in short also will be denoted in the following only as conveying rotating unit 16. The conveying rotating unit 16 is rotatably supported around a vertical rotary axis at a stationary rotating shaft structure 18 which extends vertically. The upper end of the rotating shaft structure 18 is fastened to the vertical beams 12*a*.

The conveying and bottling rotating unit 16 is drivable by means of a rotational drive unit which is disposed within the stationary assembly 10 and which can drive the conveying rotating unit 16 for rotation in at least one operation of continuous operation and fixed-cycle operation. If the conveying and bottling rotating unit 16 rotates continuously during the filling of the bottles 20 shown in FIG. 1, a particularly high bottling efficiency (number of bottles filled per time unit) can be reached.

The conveying and bottling rotating unit 16 is enclosed by a shielding wall 22 in a manner like a circular cylindrical shell which is coaxial with respect to the rotational axis of the conveying rotating unit. This can be seen particularly well from FIG. 3. The shielding wall extends from the upper side of the stationary assembly up to the upper end of the vertical beams. To completely enclose the rotating assembly the shielding wall 22 may comprise additionally a wall section formed as a plate and having a circular circumference which is disposed in a horizontal plane and links up to the upper edge of the circular cylindrical shell section of the shielding wall 22. The rotating assembly 14 would be completely enclosed by the shielding wall 22 and the stationary assembly 10 in this case.

Figure 2:
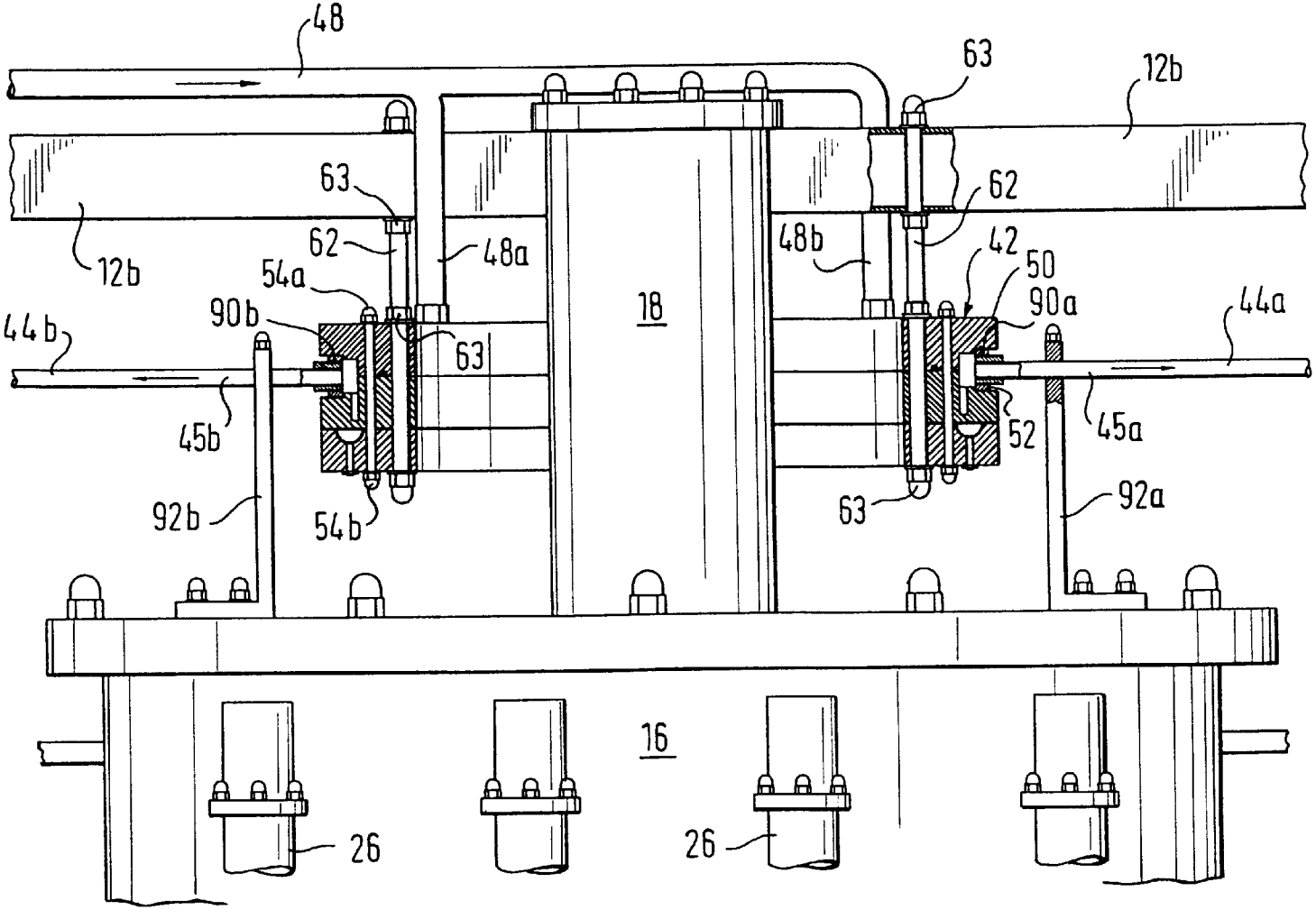
FIG. 2 shows an enlargement of a detail of FIG. 1, with the revolving joint of the bottling apparatus being depicted sectionally.

The bottling apparatus 1 is shown in FIGS. 1 to 3 only insofar in detail as it is necessary for the understanding of the invention. With respect to the general setup of bottling apparatus, numerous variants are well known. As far as that goes, FIGS. 1 to 3 depict the bottling apparatus only schematically. For example, the shielding wall 22 of course has passing-throught openings for the bottles and there are provided bottle conveying means which supply the bottles 20 to the conveying and bottling rotating unit 16 in an appropriate manner and remove the same from the bottling and conveying rotating unit again.

The conveying and bottling rotating unit 16 comprises an upper circular cylindrical section 16*a* and a lower circular cylindrical section 16*b*. To the circular cylindrical section 16*b* there are attached holding means for the bottles to be filled which holding means are diposed directly above the stationary assembly 10. The holding means are distributed over the circumference of the conveying rotating unit 16 and neighboring holding means are spaced equally in the circumferential direction. Of the holding means there are shown in FIGS. 1 and 3 only holding trays 24 on which the bottles 20 are placed. Additionally to the holding trays 24, there are provided holding means not shown which secure the bottles 20 against slipping off the holding trays 24 under the influence of centrifugal force in particular.

Each holding tray 24 has associated a handling device in the form of a filling device 26. Specifically, there is above each holding tray 24 (with respect to the holding tray offset in vertical direction) a respective filling device 26 which is attached to the upper circular cylindrical section 16*a* of the conveying and bottling rotating unit 16. The filling devices 26 as well as the holding trays 24 are connected with the conveying and bottling rotating unit 16 for common rotation. Each filling device 26 comprises an axially stationary section 26*a* which is connected with the conveying rotating unit section 16*a* via a crosspiece 28 and a lower section 26*b* which is received telescopically in the stationary section 26*a* and is movable in axial, i.e. vertical, direction. The lower section 26*b* has a charging piece and can be lowered with the charging piece onto to the bottle 20 disposed on the associated holding tray 24 to fill the same with a filling medium, in particular a beverage. The lower section 26*b* has at the lower end a filling sleeve 26*c* which surrounds the charging piece and the uppermost section of the bottle neck during the filling of the respective bottle to avoid splashing of the filling medium as far as possible. Nevertheless, a contamination of the interior of the bottling apparatus within the shielding wall 22, in particular of the inner surface of the shielding wall 22 and other components of the bottling apparatus disposed in this interior cannot be prevented completely.

The filling medium is supplied to the filling device from the interior of the conveying and bottling rotating unit 16. However, flexible conveying tubes and the like provided for this purpose are not shown in FIGS. 1 to 3 for simplicity. The filling medium is supplied to the conveying and bottling rotating unit 16 via the rotational shaft structure 18 either from below through the stationary assembly 10 or from above through at least one of the vertical beams 12*b*. As can be seen in FIG. 2, a horizontal beam 12*b* is formed as a tube. The rotating assembly 14 accordingly comprises a supply tube for the filling medium. The supply tube extends co-axially to the rotational axis of the conveying and bottling rotating unit 16 and a conventionally well—known revolving joint—also denoted as rotary distributor—is provided, which connects the supply tube with corresponding tubes of the conveying and bottling rotating unit 16 leading to the filling devices 26.

For the control of the filling devices 26 and of the holding means associated to the holding trays 24, there are attached to the vertical beams 12*a* two circular ring-shaped cams 30 which are co-axial to the rotational axis of the conveying rotating unit 16. I.e., the circular ring-shaped cams 30 are stationary. Each filling device 26 has associated two cam probing struts 32 which probe the two cams by means of a probing head sliding along the respective cam 30. The cam probing struts 32 are displaced by the respective cam more or less radially inwardly in dependence on the rotational position which the conveying and bottling rotating unit 16 has reached. The resulting radial positions of the probing struts correspond to control commands for the respective filling device and the respective holding means. In particular, a filling medium valve of the filling device 26 will be operated and the lower section 26*b* of the filling device will be raised and lowered, respectively, in dependence on the radial position of at least one associated probing strut 32. The operation of the valves and of the lower section 26*b* can be effected purely mechanically or, for example, pneumatically. In the latter case, a separate pneumatic air supply has to be provided.

As has already been mentioned, a certain contamination of the interior of the bottling apparatus with filling medium cannot be avoided completely. In particular in the case of beverages as filling medium hygienic problems (settling in of germs) may arise therefrom if the interior of the bottling apparatus including the inner surface of the shielding wall 22, the other stationary components and of course the rotating assembly 14 itself are not regularly cleaned thoroughly. To this end the bottling apparatus comprises a first cleaning means 40 for cleaning the inner side of the shielding wall 22, the cams 30 and other stationary components in the interior 2 of the bottling apparatus which are not shown in detail. The first cleaning means 40 comprises a revolving joint 42, which can also be denoted as rotary distributor, and a conduit system 44, which is connected with the conveying and bottling rotating unit 16 for common rotation. The conduit system 44 is connected with the revolving joint 42 and has several discharge openings 46 formed as nozzles. Further, the first cleaning means 40 comprises a supply line 48 leading from a cleaning fluid supply to the revolving joint 42 fastened to the support assembly 12.

The conduit system 44 comprises a first section 44*a* and a section 44*b*, which is disposed diametrically opposite the first section 44*a* with respect to the rotational axis of the conveying and bottling rotating unit 16. The two conduit system sections each comprise a tube line which firstly extends radially outwardly from the revolving joint 42 and which then bends down in vertical direction. There are tube line sections which branch off from the tube line and have nozzles 46 disposed at their ends. According to the representation in FIG. 1 each conduit system section 44*a* and 44*b* has four nozzles which particularly allow to spray the circular ring-shaped cams 30 from above and from below. Of course there may be provided even more nozzles. If, for example, the interior 2 of the bottling apparatus is closed upwardly as well by means of a corresponding wall section, it is preferred that also this wall section may be sprayed by corresponding nozzles.

In a cleaning operation phase of the bottling apparatus, the conveying and bottling rotating unit 16 will be set into rotation and cleaning fluid, in particular a cleaning liquid will be supplied to the discharge openings or nozzles 46 via the supply line 48, the revolving joint 42, the conduit system 44 rotating together with the conveying and bottling rotating unit 16. The nozzles 46 each direct a fluid jet onto a respective shielding wall section or another stationary section of the bottling apparatus. The cleaning fluid jet directed onto a shielding wall section moves over a circular ring-shaped surface of the shielding wall inner side during the rotation of the conveying and bottling rotating unit 16, so that the whole inner circumference of the shielding wall 22 can be sprayed with the cleaning fluid and therefore can be cleaned therewith. The same applies to the stationary components in the interior of the bottling apparatus. After several rotations of the conveying and bottling rotating unit 16, the whole inner circumference of the shielding wall 22 and the stationary components to be cleaned by means of the first cleaning means 40 are sprayed several times with cleaning fluid. It is clear that several different cleaning fluids may be used one after the other, for example, first a liquid cleaning chemical, then water to remove the cleaning chemical and possibly also in addition steam for sterilization. Therefore, extremely high cleanness and sterile conditions can be reached.

It has to be added that the bottling apparatus, in addition to the first cleaning means 40, may comprise a second cleaning means for the cleaning of the rotating assembly 14. The second cleaning means comprises preferably a stationary conduit system which is attached to the inner side of the shielding wall 22 or to the support assembly 12 and comprises further discharge openings preferably formed as nozzles which direct cleaning fluid onto the rotating assembly to clean the same. Accordingly, the whole interior of the bottling apparatus may be cleaned thoroughly and possibly may also be sterilized.

Figure 4:
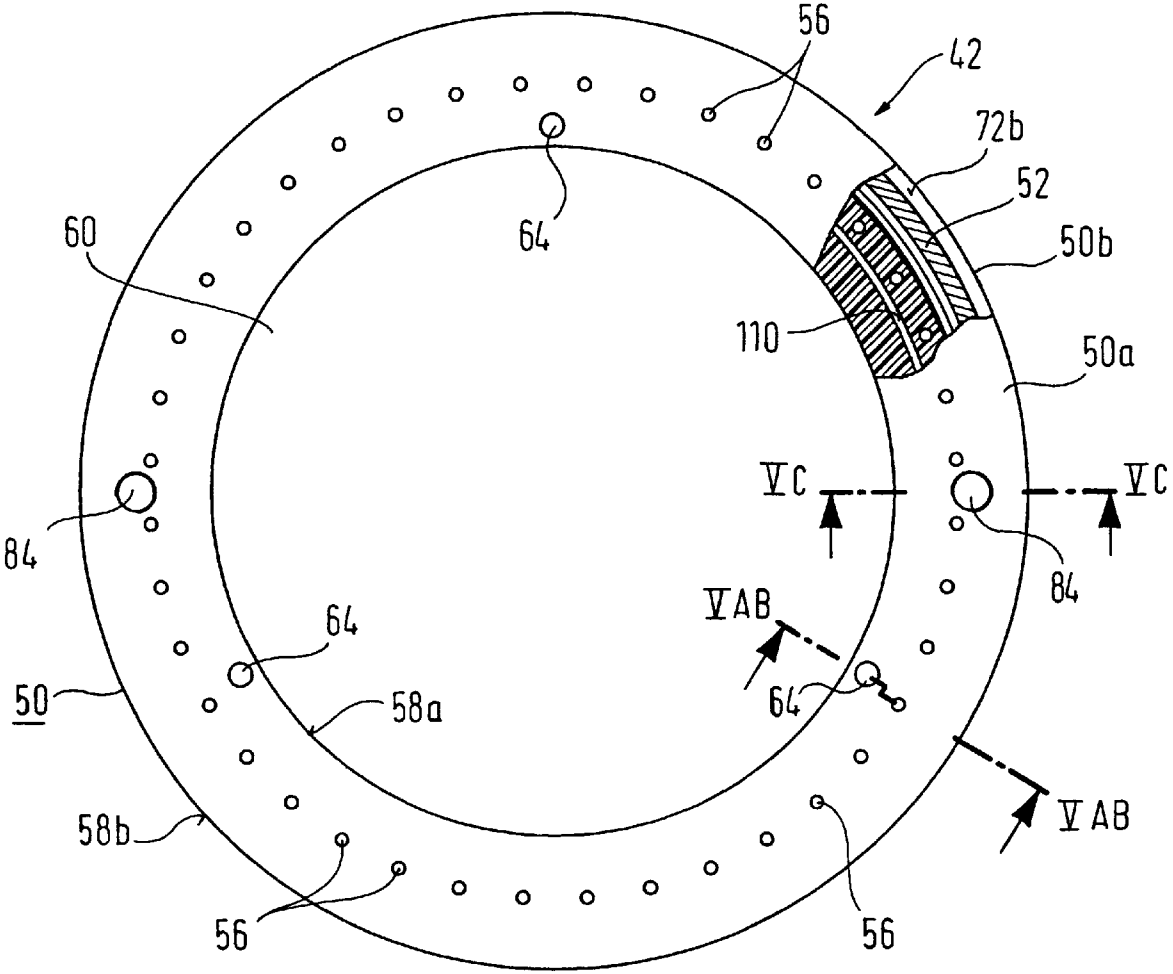
FIG. 4 shows the revolving joint of the bottling apparatus in a partially sectional top view with a section according to line IV—IV in FIG. 5*a*.

In the following, the first cleaning means 40 will be described in more detail in particular with respect to the construction of the revolving joint 42 (for this description reference is particularly made to FIGS. 2, 4 and 5).

The revolving joint 42 substantially consists of two components, namely a revolving joint stationary unit 50 manufactured from plastic (polyethylene) and a revolving joint rotating unit 52 manufactured from stainless steel. The annular (circular ring-shaped) revolving joint stationary unit is assembled sandwich-like from three partial components 50*a*, 50*b* and 50*c* and is held together by tension rods in the form of screws 54*a* each with a respective nut 54*b*. To this end, the revolving joint stationary unit 50 has a plurality of through-bores 56 which extend throught the partial components 50*a*, 50*b* and 50*c* and in which the screws 54*a* are introduced from one side and tightened from the other side with a respective nut. As can be seen in FIG. 4, the through-bores 56 are arranged on a circle with equal distance in circumferential direction and about halfway between the inner edge 58*a* and the outer edge 58*b* of the revolving joint stationary unit 50. The number of through-bores 56 and therefore of the tension rods or screws 45*a* is set such that the three partial components 50*a*, 50*b*, and 50*c* will be pressed evenly against each other along the circle defined by the through-bores 56. For this purpose, the surfaces of the partical components touching each other (the underside of the partial component 50*a* and the upper side of the partial component 50*b* as well as the underside of the partial component 50*b* and the upper side of the partial component 50*c*) are formed flat.

A symmetrical axis can be associated to the revolving joint stationary unit 50. The revolving joint stationary unit 50 (not considering the through-bores 56 and other bores) is substantially symmetrical with respect to rotation around this axis. The through-bores extend parallel with respect to this symmetrical axis which is orthogonal to the upper and lower sides of the partial components.

The revolving joint stationary unit 50 is mounted in the interior 2 of the bottling apparatus 1 above the conveying and bottling rotating unit 16 such that it encloses the rotational shaft structure 18. I.e. the rotational shaft structure 18 extends through the ringhole 60 of the revolving joint stationary unit 50. The revolving joint stationary unit 50 is attached below the horizontal beams 12*b* by means of three fastening rods 62 on these horizontal beams 12*b*. For this purpose, the revolving joint stationary unit 50 has three further through-bores 64 having a larger diameter than the through-bores 56 with the through-bores 64 being nearer to the inner edge 58*a* than the through-bores 56 and being arranged in correspondence to the arrangement of the horizontal beams 12*b*, so that there is associated to each horizontal beam 12*b* a fastening rod 62 and a through-hole 64.

The respective fastening rod 62 is formed as a threaded bolt and extends in vertical direction through the corresponding through-bore in the horizontal beam 12*b* and the through-bore 64 through all three partial components 50*a*, 50*b*, and 50*c*. The fastening rods or threaded bolts are each fixed by means of two nuts 63 at the respective horizontal beam 12*b* and the revolving joint rotating unit 52 is fixed by means of two further nuts 63 at the respective fastening rod. The revolving joint rotating unit 52 is arranged such that its symmetrical axis substantially coincides with the rotational axis of the conveying and bottling rotating unit 16.

In the outer circumferential surface of the revolving joint stationary unit 50 an annular groove 70 is formed, namely in the lower end section of the uppermost partial component 50*a* and in the upper end section of the intermediate partial component 50*b*, with the annular groove 70 being radially outwardly open. The two partial components 50*a* and 50*b* abut against each other in a horizontal divisional plane. This horizontal divisional plane divides the annular groove 70 into an upper and a lower section which are symmetrical with respect to each other.

The annular groove 70 comprises a radially outer section which is wider in axial direction and a radial inner section which is less wide in axial direction, with the sections adjoining each other stepwise. The radial outer section is limited in axial direction by two annular surfaces 72*a* and 72*b* which are formed as sliding surfaces and lie in a respective horizontal plane. The two annular surfaces 72*a* and 72*b* which will be denoted as sliding surfaces in the following, accordingly face each other.

The revolving joint rotating unit 52 is received within the radial outer section of the annular groove 70. The revolving joint rotating unit 52 is formed as an annular body which is symmetrical with respect to rotation (in the arrangement described the annular body has a vertical symmetrical axis). The revolving joint rotating unit 52 has at its upper and its lower side a annular surface 74*a* and 74*b*, respectively, which lies in a horizontal plane. These annular surfaces are formed as sliding surfaces as well and will be addressed in the following as sliding surface 74*a* and sliding surface 74*b*. Of the two sliding surfaces 74*a* and 74*b* which are turned away from each other, the sliding surface 74*a* is disposed opposite of the sliding surface 72*a* and the sliding surface 74*b* is disposed opposite to the sliding surface 72*b*.

The revolving joint stationary unit 50 and the revolving joint rotating unit 52 bear against each other via the sliding surfaces 72*a*, 72*b* and 74*a*, and 74*b*. The revolving joint rotating unit 52 has, as can be seen from FIG. 5, radial play with respect to the revolving joint stationary unit 50, since a diameter referring to the inner circumference 81 of the revolving joint rotating unit 52 is larger than a diameter referring to the circular cylindrical limiting surface between the inner and the outer section of the annular groove 70. At the transition between the radial inner and the radial outer section of the annular groove 70 there is formed a circular cylindrical annular surface 76*a* and 76*b* at the upper partial component 50*a* and at the lower partial component 50*b*, respectively, which limit the radial play of the revolving joint rotating unit 42 with respect to the revolving joint stationary unit 50. These surfaces may appropriately be denoted as abutment surfaces 76*a* and 76*b*.

Between the inner circumferential surface 81 a of the revolving joint rotating unit 52 and a bottom 80 of the annular groove 70, which bottom is opposite to the inner circumferential surface, a ring chamber 82 is formed. This ring chamber corresponds substantially to the radial inner section of the annular groove 70. Two axial blind-end bores 84 are connected with the ring chamber 82, which extend through the partial component 50*a* and end in the partial component 50*b*. These blind-end bores 84 which are disposed diametrically opposite to each other serve as connections for the cleaning fluid to supply the same to the ring chamber 82. The blind-end bores 84, therefore, will be denoted also as connection bores in the following. With each connection bore 84 there is connected a supply section 48*a* branching off from the supply line 48 and an end section 78*b* of the supply line 48, respectively.

The revolving joint rotating unit 52 has two diametrically opposite, radially extending through-bores 90*a* and 90*b*. These through-bores 90*a* and 90*b* serve as connections as well, to which the section 44*a* and 44*b*, respectively, of the conduit system 44 is connected. The connection is effected via a tube section 45*a* or 45*b* of the conduit system section 54*a* or 54*b* which tube section is fixed within the respective through-bore 90*a* or 90*b*. The respective tube section 45*a* or 45*b* is connected substantially rigid with the revolving joint rotating unit 52 and extends in radial direction.

On the upper side of the conveying and bottling rotating unit 16 there are fixed two entrainment means 92*a* and 92*b* which comprise a respective finger section extending in radial direction. In the upper end section of the respective finger section there is provided a through-bore through which the tube section 45*a* or 45*b* extends. The entrainment means are only slightly displaced radially outwardly with respect to the revolving joint rotating unit 52, so that the entrainment means engages near the revolving joint rotating unit 52 at the tube section 45*a* or 45*b*. During the rotation of the conveying and bottling rotating unit 16 this conveying and bottling rotating unit 16 entrains the revolving joint rotating unit 52 via the entrainment means 92*a* and 92*b* and the tube sections 45*a* and 45*b*. Because of the engagement points of the entrainment means at the tube sections being near to the revolving joint rotating units 52, damaging, in particular bending, of the tube sections which is caused by forces acting on the tube sections and being increased by lever effects will be avoided. Accordingly, the revolving joint rotating unit 52 is connected with the conveying and bottling rotating unit 16 and, thus, with the whole rotating assembly 14 for common rotation, whereas the revolving joint stationary unit 50 is fixed to the stationary assembly 10 via the support assembly 12 to prevent rotation.

The revolving joint 42 has two operating modes. In a first operation mode, which can also be denoted as "dry running operating mode", the sliding surfaces 52*a, b* and 54*a, b* serve as sliding surfaces alone and allow for a rotation of the revolving joint rotating unit 52 with respect to the revolving joint stationary unit 50 with low friction. In this first operation mode, the sliding surface 72*a* and 74*a* and the sliding surfaces 72*b* and 74*b* abut against each other only with little exerting of force. The axial distance between the sliding surfaces 74*a* and 74*b* of the revolving joint stationary unit 50 may slightly exceed the distance between the sliding surfaces 74*a* and 74*b* of the revolving joint rotating unit 52. In the first operating mode the ring chamber 82 is not sealed radially outwardly.

In a second operation mode which may also be denoted as "operation mode for fluid transport", the sliding surfaces 72*a* and 74*a* and the sliding surfaces 72*b* and 74*b* are pressed against each other by setting means to be described in more detail so that these sliding surfaces serve as sealing surfaces as well. In this second operation mode the ring chamber 82 is sealed radially outwardly by the sliding surfaces serving as sealing surfaces. Because of the pressing force causing the sealing abutment of the sliding surfaces the friction between the sliding surfaces 72*a* and 74*a* and between the sliding surfaces 72*b* and 74*b* is now increased, however. Then, however, the friction heat produced thereby is transported away without further ado if fluid is flowing from the supply line 48 through the through-bores 84, through the ring chamber 82 and through the through-bores 90*a* and 90*b* into the conduit system 44.

To provide for the two operation modes of the revolving joint 42, the sliding surface 72*b* is arranged on an axially movable flange 94 of the intermediate partial component 50*b*. The flange 94 is formed with a weakening recess in the form of an annular groove 98 which is axially upwardly open, to increase the axial movablility or deflectability of the flange 94 and therefore of the sliding surface 72*b*.

The setting means for the deflection of the flange 94 comprises an annular groove 100 in the upper side of the lower partial component c. The annular groove 100 which is semi-circular shaped in a cross section is open axially upwardly. An inflatable ring-shaped flexible tube 102 is received within this annular groove 28 which flexible tube can also be denoted as inflating tube or annular tube. As tube a simple bicycle tube can be used, for example. The flexible tube 102 comprises a connection piece 104 (in the case of a bicycle tube the reception for the bicycle valve), which extends axially downwardly and projects from the underside of the lower partial component 50*c*. A pneumatic line 106 is connected with the connection piece 104, so that the inflating tube 102 selectively may be put under pressure, i.e. can be inflated, or the air within the inflating tube 102 may be let off again. If the inflating tube 102 is inflated, it completely fills the annular groove 100 and presses against the underside of the intermediate partial component 50*b* mainly in the region of the flange 94. In this manner the inflating tube bears on the partial component 50*c*. This partial component 50*c* accordingly can be denoted as supporting plate.

Figure 5:
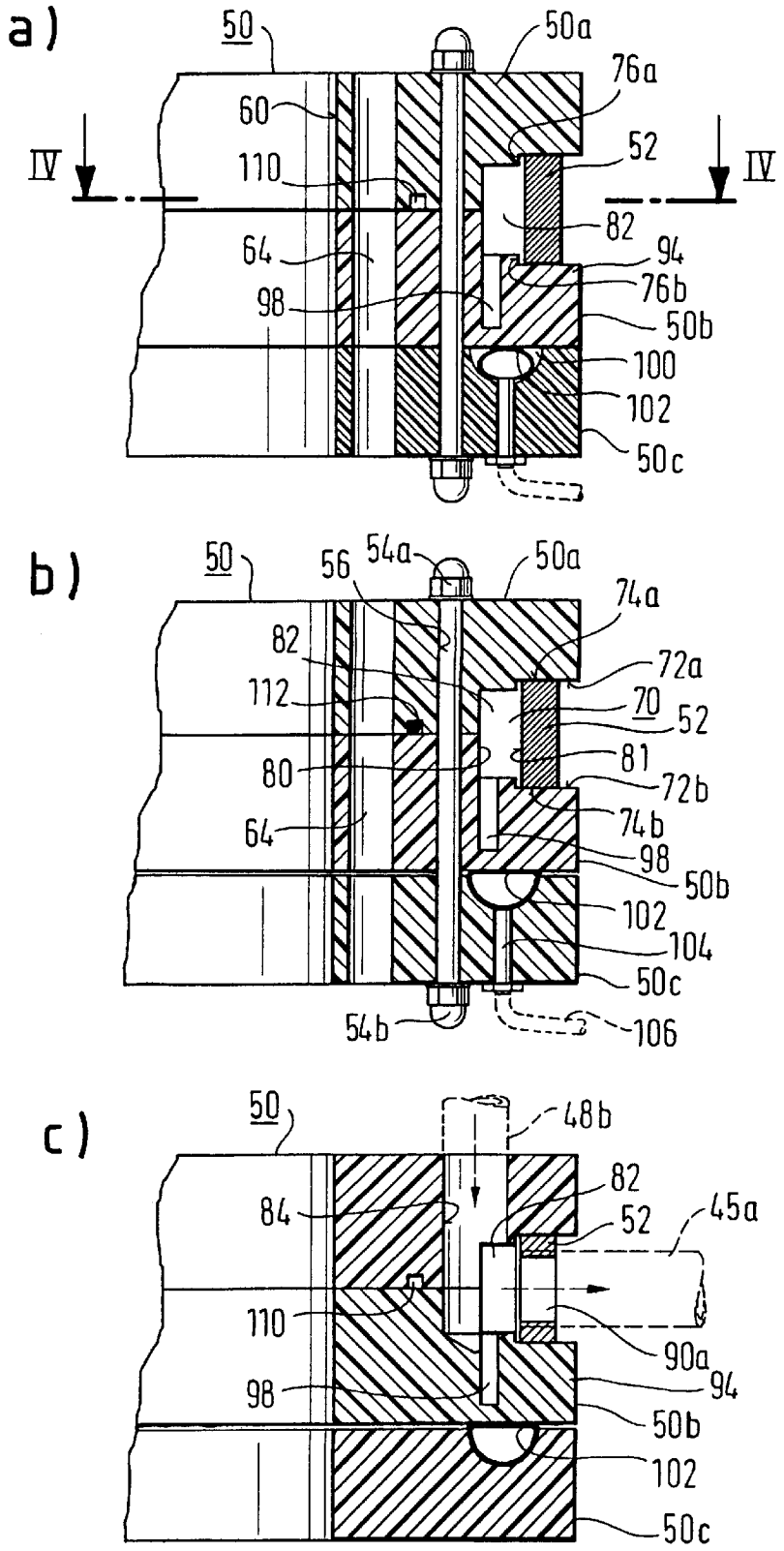
FIG. 5 shows in FIGS. 5*a* and 5*b* a section according to VAB—VAB of FIG. 4 in two different operation conditions of the revolving joint and in FIG. 5*c* a section according to line VC—VC in FIG. 4 in the operation condition of the revolving joint corresponding to FIG. 5*b*.

The two operating modes can be recognized well in FIG. 5. In FIG. 5*a* the inflating tube 102 is not inflated or only insignificantly inflated, so that substantially no pressure force is exerted on the flange 94. The revolving joint 49 correspondingly is in the first operating mode. In FIGS. 5*b* and 5*c*, the inflating tube is inflated and exerts a pressure force onto the flange 94, which pressure force is directed axially upwardly, so that the flange is deflected for sealing abutment of the sliding surfaces 72*a* and 74*a* and the sliding surfaces 72*b* and 74*b* against each other. Accordingly, the revolving joint 42 is in the second operating mode.

With respect to the sealing of the ring chamber 82 it is to be added that the ring chamber is sealed radially inwardly. For this purpose there is provided an annular groove 110 at the underside of the uppermost partial component 50*a*, which annular groove is axially downwardly open and which receives a O-ring 112. This O-ring 122 is only indicated in FIG. 5*b*.

The described construction of the revolving joint 42 makes it possible that during the bottling, i.e. during the working operation of the bottling apparatus, the sliding surfaces 72*a* and 74*a* and the sliding surfaces 72*b* and 74*b* are disposed opposite to each other substantially without sealing force so that only extremely insignificant friction occurs between them. The revolving joint 42 is brought into the first operating mode (dry running operation mode) for this bottling, in that no pneumatic air is applied to the inflating tube 102 or air contained within the flexible tube is let off, so that the flexible tube is not inflated.

At certain time intervals, the working operation of the bottling apparatus is interrupted for cleaning operation phases. During these cleaning operation phases, the sliding surfaces 72*a* and 74*a* and the sliding surfaces 72*b* and 74*b* are pressed sealingly against each other, by application of pneumatic air to the inflating tube 102 to inflate the same and to exert the pressure forces on the flange 94, which are necessary for the pressing of the sliding surfaces against each other. In this case, the revolving joint 42 is in the second operation mode (operation mode for fluid transport) and cleaning fluid is transported from the cleaning fluid supply to the nozzles 46 via the supply line 48, the ring chamber 82, the conduit system 44. The nozzles 46 direct, as has already been described above, a respective cleaning fluid jet, in particular cleaning liquid jet, to the inner side of the shielding wall 22 and onto other stationary components (such as the circular ring-shaped cams 30, for example) to clean the same. After termination of the cleaning, i.e. after termination of the cleaning operating phase, the air is let off from the inflating tube 102 again, so that the revolving joint 42 adopts the first operation mode again and the working operation of the bottling apparatus can be continued.

Certainly it stands to reason that the revolving joint 42 may be used in all cases in which fluid has to be transferred from a stationary assembly to a rotating assembly. The orientation of the rotational axis of the rotating assembly is of no concern. The rotational axis of the rotating assembly may also be horizontal or may be inclined with respect to a horizontal plane or a vertical plane leading to a corresponding orientation of the rotational axis of the revolving joint rotating unit. The revolving joint according to the invention having setting means is particularly advantageous if the fluid does not have to be transferred permanently from the stationary assembly to the rotating assembly. As long as no fluid has to be transferred, the revolving joint is set into the first operation mode (dry running operating mode), so that there is only minor friction between the revolving joint stationary unit and the revolving joint rotating unit. The wear and tear of the revolving joint is reduced in this way, and there is no danger of overheating of the revolving joint because of friction heat. For the transfer of the fluid to the rotating assembly, the revolving joint is set into the second operating mode (operation mode for fluid transport). The friction which is increased in this operation mode because of the sealing abutment of the sliding surfaces is—as mentioned—harmless, since the generated friction heat will be transported away by the fluid. The revolving joint according to the invention having radial play between the revolving joint stationary unit and the revolving joint rotating unit and possibly being shaped as a ring is particularly advantageous for retrofitting purposes.

Summarizing, the invention concerns a rotating apparatus for the handling of objects, in particular containers, for examples for the filling of said containers. The rotating apparatus comprises a stationary assembly and a rotating assembly which is rotatable with respect to the stationary assembly and is driven by a rotary drive. According to the invention there is provided on the rotating assembly at least one discharge opening for the discharge of a cleaning fluid for cleaning a shielding wall being stationary during the rotational operation of the rotating assembly and optionally for cleaning other stationary components. The at least one discharge opening is connected to a stationary cleaning fluid supply via a revolving joint. For the revolving joint it is proposed that the revolving joint comprises a revolving joint stationary unit fixed or fixable to the stationary assembly and a revolving joint rotating unit connectable or connected to the rotating assembly for common rotation. Said two rotating joint components are rotatably supported at each other by axially directed sliding surfaces.

Besides the designs of the rotating apparatus according to the invention proposed above (in which—in deviation of the statements in the beginning—a shielding wall which at least partially encloses the rotating assembly and which is stationary during the rotational operation of the rotating assembly may be omitted and in which there is arranged on the rotating assembly at least one discharge opening for the discharge of a cleaning fluid for cleaning at least one of the shielding wall and other stationary components of the rotating apparatus) and of the revolving joint according to the invention, other advantageous designs are possible. As a particularly advantageous design it is proposed that at least one sliding surface of at least one of the two revolving joint components is formed on a ring plate which is elastically deformable and that this ring plate has a loading zone in radial distance from the sliding surface for loading by an axially directed setting force. In a further ring zone, in particular in an intermediate zone between the sliding surface and the loading zone, a supporting zone for the ring plate is provided so that by loading of the loading zone with setting force an axial movement of the sliding surface is introduced, in particular an axial movement, which is opposed to the direction of the loading with the setting force.

According to this suggestion a particularly simple design of the revolving joint according to the invention is achieved keeping the manufacturing costs low. According to this suggestion, the revolving joint according to the invention may have a particularly low height in axial direction, for example achieved in such a way that setting means which are possibly provided are displaced primarily in radial direction with respect to the sliding surfaces and at the most only insignificantly in axial direction, so that they are disposed substantially in the same axial region of the revolving joint as the sliding surfaces. For the low overall height of the revolving joint in axial direction, a further contribution is obtained if the elastically deformable ring plate is made from metal, for example, stainless steel, so that particularly low dimensions of the ring plate in axial direction are possible.

The elastically deformable ring plate preferably forms with its sliding surface a limiting wall of an ring-shaped radially open annular groove which receives the respective other revolving joint component. The ring plate may be supported on a ring plate carrier (for example made from plastic) with formation of the supporting zone between the ring plate and the ring plate carrier. In this context, it is proposed that there are arranged setting means (for example in the form of at least one inflating tube) on the ring plate carrier in the region of the loading zone, which are axially effective.

There may be arranged two ring plates on the ring plate carrier with the sliding surfaces of the plates receiving the respective other revolving joint component between them. This design of the rotating apparatus and the revolving joint is preferred particularly.

In the absence of an external setting force, the sliding surface of the ring plate is preferably out of sealing contact with an associated countersliding surface of the respective other revolving joint component wherein the sliding surface and the countersliding surface can be brought in sealing contact by introduction of a setting force from the outside. Accordingly, the sliding surfaces can lie opposite each other substantially without any sealing force in a first operation mode of the revolving joint (working operation of the rotating apparatus) and can be pressed sealingly against each other for a second operation mode of the rotating apparatus (cleaning operation phase of the rotating apparatus). Thus, in said first operation mode, an excessive warming up or heating up of the sliding surfaces because of friction heat is avoided despite a rotational movement of the two revolving joint components with respect to each other, which possibly takes place.

The setting force need only be applied for the adjustment of the second operation mode so that the setting means which possibly are provided for this purpose are only put under strain in this second operation mode. In case of an absence of the setting force, for example because of a failure of the setting means or of a pressure medium supply for the setting means, which is possibly provided, the first operating mode inevitably is adopted so that the normal working operation of the rotating apparatus is not disturbed.

To avoid an excessive warming up or heating up of the sliding surfaces or the revolving joint also in the second operation mode in case that the revolving joint components rotate with respect to each other, it is suggested as being particularly advantageous that the revolving joint has supply means for a sliding or/and heat carry-off fluid which allow the supply of the sliding or/and heat carry-off fluid to sliding surfaces of the revolving joint.

By corresponding supply of the sliding or/and heat carry-off fluid the friction between the sliding surfaces can be reduced and, accordingly, the resulting friction heat can be minimized or excessive friction heat can be led away so that the revolving joint may have a particularly high service life and needs substantially no, or only minimal, maintenance.

The sliding or/and heat carry-off fluid may be formed by the cleaning fluid. Accordingly, a sliding or/and heat carry-off fluid supply separate with respect to the stationary cleaning fluid supply provided according to the invention is unnecessary.

The supply of the sliding or/and heat carry-off fluid to the sliding surfaces may be effective timewise out of cleaning periods, for example by providing that out of cleaning periods a reduced cleaning fluid flow is supplied which only serves the purpose of reducing the friction or the purpose of carrying off heat or that out of cleaning periods a sliding or/and heat carry-off fluid (in particular a sliding or/and heat carry-off liquid, for example water) separate from the cleaning fluid is supplied.

For the supply of the heat or/and heat carry-off fluid, supply means may be provided which are independent of the conduit system of the cleaning fluid.

With regard to the low axial overall height of the revolving joint it is preferred that at least one connection, preferably all of the connections: cleaning fluid connection at the revolving joint stationary unit, cleaning fluid connection at the revolving joint rotating unit, possibly sliding or/and heat carry-off fluid connection of the revolving joint and (in the case of setting means) possibly pressure medium connection of the revolving joint are formed as radial connections.

In the following, the invention will be explained in more detail by means of a further embodiment shown in FIGS. 6 and 7.

Figure 6:
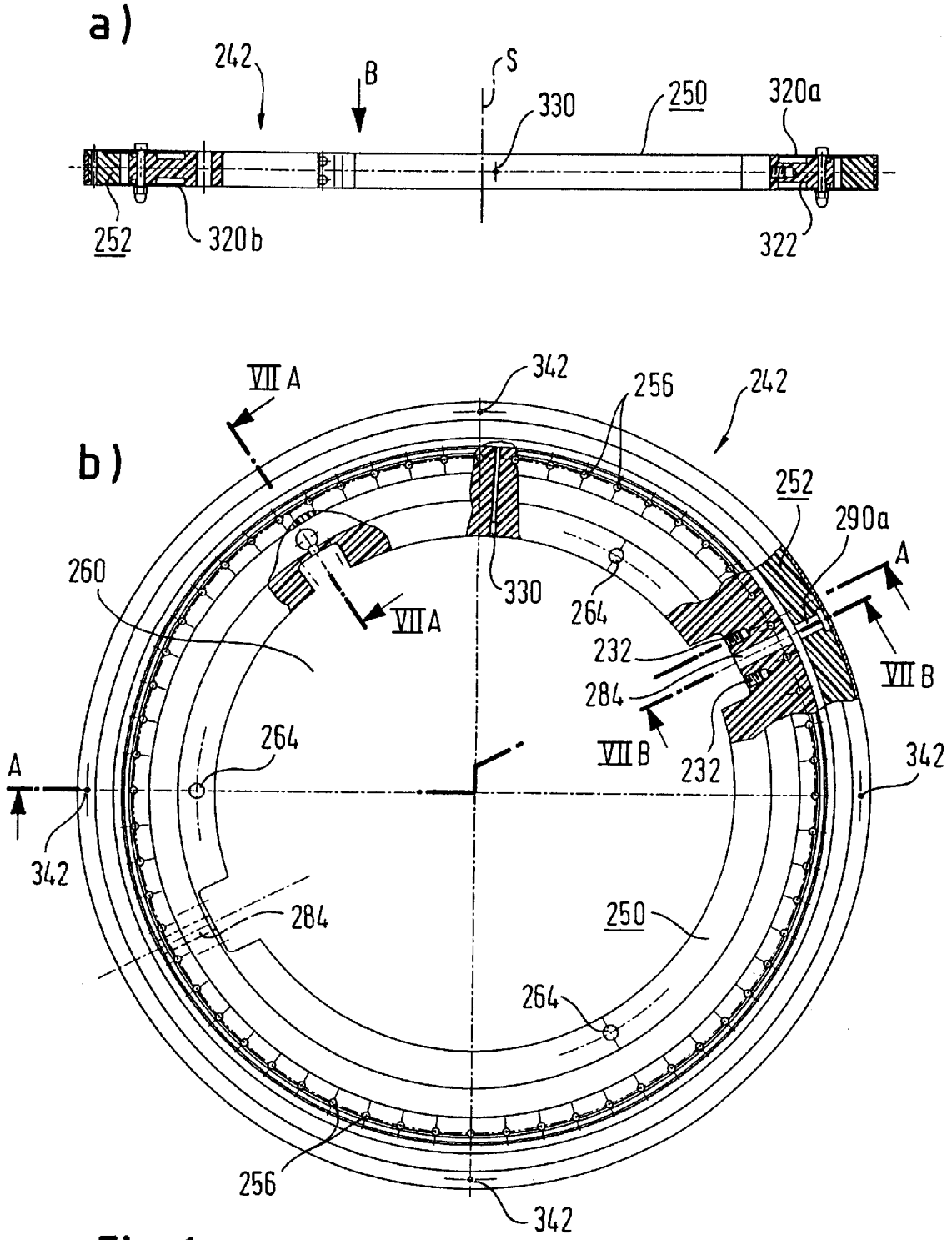
FIG. 6 shows in FIG. 6*a* a cross-section through a revolving joint according to the invention along line A—A in FIG. 6*b* which could be provided in the rotating apparatus of FIG. 1 in place of the revolving joint of FIGS. 4 and 5, and in FIG. 6*b* a top view onto the revolving joint of FIG. 6*a* according to the viewing direction indicated by means of arrow B.
Figure 7:
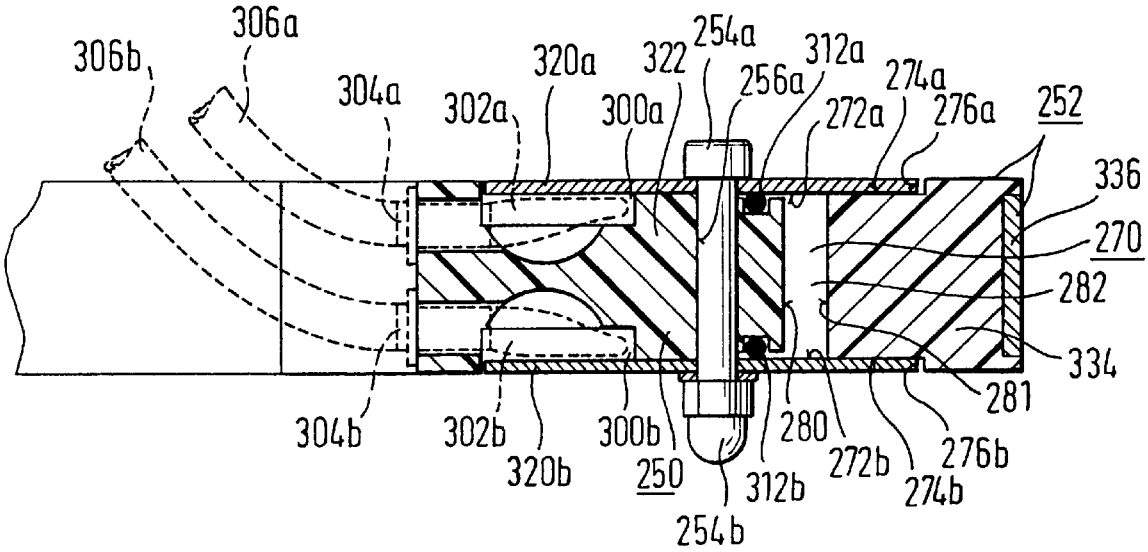
FIG. 7 shows in FIG. 7*a* section through the revolving joint to FIG. 6 along line VIIA—VIIA in FIG. 6*b* and in FIG. 7*b* a section through this revolving joint along line VIIB—VIIB in FIG. 6*b*.
Figure 7:
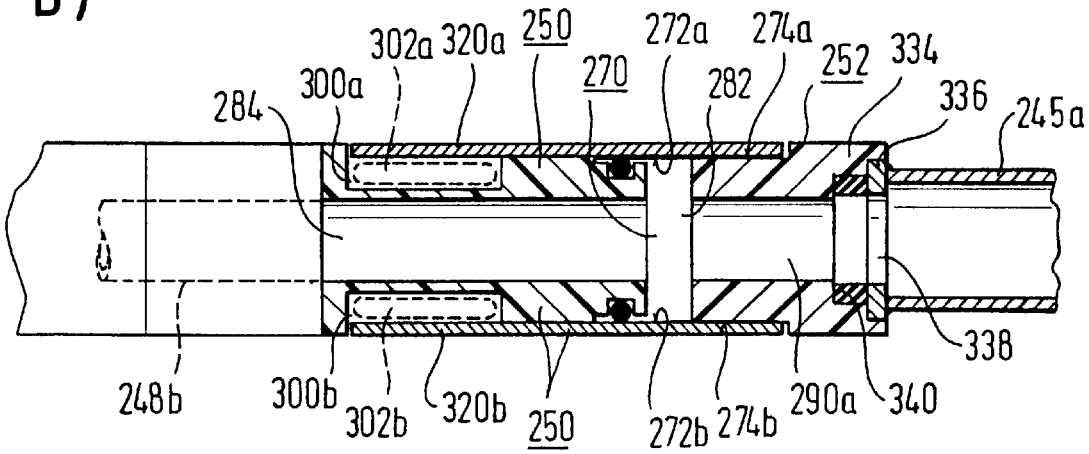

The second embodiment of FIGS. 6 and 7 is explained in the following only with regard to the differences from the first embodiment of FIGS. 1 to 5. As far as that goes, reference is made expressis verbis to the foregoing description of the first embodiment. Components of the second embodiment whose function corresponds to components of the first embodiment are provided with the same reference numbers which, however, are increased by the number 200.

The revolving joint 242 which according to FIG. 6*a*—with the exception of deviations to be seen in FIG. 6—is rotationally symmetrical to a symmetrical axis S extending vertically comprises, as the revolving joint 42 of FIGS. 1 to 5, a revolving joint stationary unit 250 and a revolving joint rotating unit 252. The revolving joint stationary unit 250 comprises two ring plates 320*a* and 320*b* which are mounted by means of tension rods (screws 254*a* with nuts 254*b*) to the axial ends of an annular ring plate carrier 322. The ring plates project over the ring plate carrier 322 radially outwardly and the surfaces of the ring plates projecting radially outwardly beyond the ring plate carrier 322 and facing each other serve as sliding surfaces 272*a* and 272*b*.

The ring plates 320*a* and 320*b* are manufactured from stainless steel and are resiliently deformable. By means of the tension rods 254*a*, 254*b* the ring plates are held axially in a region of a supporting zone which lies radially more inwardly than the sliding surfaces. The ring plates abut in the region of the annular supporting zone and also radially more inwardly against the ring plate carrier 322.

Radially outwardly of the supporting zone defined by the tension rods 254*a*, 254*b*, the axial dimension of the ring plate carrier 122 is somewhat reduced, as can be seen in FIG. 7, so that the axial distance between the sliding surfaces 272*a* and 272*b* can be reduced under corresponding elastic deformation of the ring plates 320*a*, 320*b* and also (to a certain amount) of the tension rods by exerting of a corresponding setting force onto the ring plates in a region which lies radially more inwardly with respect to the supporting zone. For this purpose there are provided setting means in the form of two inflating tubes 302*a* and 302*b* which are disposed radially more inwardly than the supporting zone.

The inflating tubes 302*a* and 302*b* are disposed respectively in an annular groove 300*a* or 300*b* of the ring plate carrier 322 preferably being manufactured from plastic, with the annular groove being open in axial direction and being covered by a ring section of the ring plate 320*a* or 320*b* which lies radially inwardly. The inflating tubes serve for loading the axially opposite ring section of the respective ring plate 320*a* or 320*b* with a setting force which is axially directed, to obtain an axial movement of the sliding surface 274*a* and 274*b* opposite to the direction of the loading with the setting force, if the sliding surfaces 274*a* and 274*b* have to be brought into sealing contact or sealing engagement (second operation mode of the revolving joint 242) with the respectively associated axially opposite sliding surface 274*a* or 274*b* of the revolving joint rotating unit 252, which to the greater part (also in the region of the sliding surfaces 274*a* and 274*b*) is manufactured from plastic.

For exerting the axially directed setting forces onto the ring plates 320*a*, 320*b* the flexible pressure tubes 302*a* and 302*b*, which define a loading zone, are inflated by introduction of a pressure medium via lines 306*a*, 306*b* for the pressure medium. To bring the revolving joint 242 from the second operation mode (operation mode for fluid transport) again into the first operation mode (dry running operation mode) the pressure medium (in particular pneumatic air) will again be let off from the inflating tubes, so that an elastic restoring force arising from the elastic deformation of the ring plates 320*a* and 320*b* displaces the sliding surfaces 274*a*, 274*b* axially from each other and accordingly brings the same out of sealing engagement with the sliding surfaces 274*a* and 274*b* of the revolving joint rotating unit 252.

For the sealing of the ring chamber 282 radially inwardly for the operating mode for fluid transport, which chamber is limited axially between the ring plates 320*a*, 320*b* and radially between an outer circumferential surface of the ring plate carrier 322 forming the bottom 280 of the annular groove 270 and the inner circumferential surface 281 of the ring-shaped revolving joint rotating unit 252, there are provided two O-rings 312*a* and 312*b* located in a respective annular groove of the ring plate carrier 322. The O-rings sealingly engage radially outwardly of the tension rods 254*a*, 254*b* on the surfaces of the ring plates 320*a* and 320*b* comprising the sliding surfaces 272*a* and 272*b*.

To be able to reduce the friction which already is substantially reduced because of the missing sealing engagement between the sliding surfaces 272*a* and 274*a* and 272*b* and 274*b* associated to each other, even further in the first operation mode (dry running operation mode) or to be able to carry off—independently of the supply of the fluid (for example cleaning fluid in the case of the bottling apparatus 1) to be transported in the second operation mode via the connection bores 284 to the ring chamber 282—friction heat arising from this reduced friction and correspondingly being reduced, the revolving joint stationary unit 250 comprises additionally to the connecting bores 284, which are directed radially in the described embodiment a further connection bore 330 being also directed radially (compare FIG. 6). Via this connection bore 330, a fluid (sliding or/and heat carry-off fluid, for example water) being separate from the fluid to be transported in the second operation mode may be supplied to the ring chamber 282 and, therefore, to the sliding surfaces 272*a*, 274*a*, 272*b*, 274*b*. This sliding or/and heat carry-off fluid will leak to a certain extent between the sliding surfaces, since in the first operation mode there is no sealing engagement between the sliding surfaces being associated to each other. However, this can be accepted, in particular if the sliding or/and heat carry-off fluid is simple water, for the benefit of the friction being further reduced or for the benefit of an improved carrying-off of heat in the first operation mode and, therefore, for the benefit that the service life of the revolving joint is increased further. The amount of sealing or/and heat carry-off fluid leaking out cannot be very large, provided that this fluid is supplied to the ring chamber 282 under low pressure which generally will be sufficient for a substantial reduction of the friction between the sliding surfaces. In the second operation mode serving for the transport of fluid, however, one will often operate with relatively high pressure so that for this operation mode, the sealing engagement between the sliding surfaces 272*a*, 274*a* and 272*b*, 274*b* being associated to each other and being axially directed will generally be indispensable because of the major loss of fluid which otherwise will occur in case of a high fluid pressure.

As has already been mentioned, the connection bores 284 for the fluid supply in the second operation mode are directed radially, so that the fluid to be transported will be supplied to the ring chamber 282 radially from the inner side. In FIG. 6*b* there are to be seen two threaded bores 232 neighboring to the connection bores 284, which threaded bores 232 serve for the fastening of a connection flange of a corresponding fluid supply line at the revolving joint stationary unit 250. Also, the supply of a pressure medium to the inflating tubes 302*a* and 302*b* takes place radially from the inner side (compare 7*a*) and the flowing off of the fluid from the ring chamber 282 via the revolving joint rotating unit 252 takes place in radial direction as well, namely radially outwardly (compare throughbore 290*a* and tube section 245*a* in FIG. 7*b*). The same applies to the possible supply of a sliding or/and heat carry-off fluid via the bore 330 in the revolving joint stationary unit 250 which bore 330 is directed radially as well. Because of this radial alignment of all fluid or pressure medium connections, a particularly low overall height of the revolving joint 242 in axial direction (axis S) results. The revolving joint 242 can therefore often be retrofitted also in case of restricted space conditions in a rotating apparatus (for example a bottling apparatus) which is substantially ready for operation.

It has to be mentioned additionally for the revolving joint rotating unit 252 that this unit carries in a radially outwardly open annular groove in a ring-shaped main rotating unit part 334 manufactured from plastic a stainless steel ring 336, which has bores 338 aligned with the throughbores 290 for passing through of the fluid to be transported. The tube sections 245 (tube section 245*a* in FIG. 7*b*) are welded to the stainless steel ring so that a fluid connection is established between the connection bores 284 and the conduit system (which leads to the nozzles 46 in case of the embodiment of FIG. 1) linking up with the tube sections 245 via the bores 290, 338 and the ring chamber 282. For sealing there is provided concentrically to the bore 338 in the stainless steel ring 336 a sealing ring 340 which is sealingly effective between the main rotating unit part 334 and the stainless steel ring 336.

A rotational entrainment of the revolving joint rotating unit 252, in case of an application corresponding to FIG. 1, can be effected via the tube sections 245 as shown in this figure. Alternatively, it is suggested to drive the revolving joint rotating unit 252 for rotation via flexible tension elements, for example tension cables, which engage on one side at the rotatably driven rotating assembly and on the other side at the revolving joint rotating unit, preferably via a safety element being effective between one of rotating assembly and tension element on one hand and tension element and revolving joint rotating unit on the other hand. The safety element may be in the form of a shearing bolt. In this way, an interruption of the operation of the rotating apparatus because of blockage of the revolving joint rotating unit possibly because of an operating error (sealing engagement of the sliding surfaces when the revolving joint rotating unit is rotating without supply of fluid to be transported and without supply of sliding or/and heat carry-off fluid) is prevented, since after response of the safety element for disconnecting the rotational drive connection between the rotating assembly and revolving joint rotating unit a free rotation of the rotating assembly is possible. Such a shearing bolt, on which the tension element engages, for example could be inserted into one or several of the four axial bores 342 in the revolving joint rotating unit 252 which bores can be seen in FIG. 6*b*.

We claim:

1. A rotary object handling appartus for handling of objects, comprising a stationary assembly, a rotating assembly driven by a rotary drive and rotatable about an axis with respect to the stationary assembly, receptacles for the objects arranged along a circumference of the rotating assembly for common rotation therewith to move the objects along a handling course along the circumference, handling devices for the handling of the objects in the course of being moved along the handling course, at least one discharge opening on the rotating assembly arranged for common rotation therewith and adapted to discharge a cleaning fluid for cleaning of stationary components of the apparatus, the at least one discharge opening being connected with a stationary cleaning fluid supply by a revolving joint, the revolving joint having a stationary unit that is fixed to the stationary assembly to prevent rotation with the rotating assembly and a rotating unit that is connected with the rotating assembly for rotation therewith, the stationary unit and the rotating unit being supported one by the other by axially directed sliding surfaces for rotation of the rotating unit relative to the stationary unit.

2. The apparatus according to claim 1, wherein the apparatus is a rotary container handling apparatus for handling of containers, the handling devices being handling devices for handling containers.

3. The apparatus according to claim 2, wherein the handling of containers comprises at least one of cleaning, filling, closing, labeling, singling, sorting and aligning the containers.

4. The apparatus according to claim 1, wherein the apparatus is a rotary bottle handling apparatus for handling of bottles, the handling devices being handling devices for bottles.

5. The apparatus according to claim 1, wherein the handling of objects comprises at least one of cleaning, labeling, singling, sorting and aligning the objects.

6. The apparatus according to claim 1, wherein the stationary cleaning fluid supply is a stationary cleaning liquid supply for supplying cleaning liquid as cleaning fluid to the at least one discharge opening.

7. The apparatus according to claim 1, wherein a shielding wall at least partially encloses the rotating assembly and which is stationary during a rotational motion of the rotating assembly, the at least one discharge opening being arranged to discharge cleaning fluid for cleaning the shielding wall.

8. The apparatus according to claim 1, wherein the rotating unit and stationary unit of the revolving joint have radial play with respect to each other.

9. The apparatus according to claim 1, wherein the sliding surfaces are also sealing surfaces.

10. The apparatus according to claim 9, wherein there are provided setting means which are mounted on at least one of the two units of the revolving joint which are axially effective for holding the sliding surfaces in sealing abutment with each other.

11. The apparatus according to claim 1, wherein one of the units of the revolving joint is formed with sliding surfaces facing each other and the other of the units of the revolving joint is formed with sliding surfaces facing away from each other.

12. The apparatus according to claim 11, wherein the one revolving joint unit includes at least two partial components which are combined in a dividing plane disposed between its two sliding surfaces facing each other.

13. The apparatus according to claim 11, wherein at least one of the two sliding surfaces facing each other is arranged on a flange of the one revolving joint unit, which flange is axially movable, and that the flange is exposed to the influence of setting means which are axially effective for moving the flange and disposed on the one revolving joint unit.

14. The apparatus according to claim 13, wherein the setting means is axially effective and is formed by an inflating tube which is supported on a supporting surface of the one revolving joint unit, which supporting surface is axially adjacent the flange.

15. The apparatus according to claim 14, wherein the inflating tube is annular.

16. The apparatus according to claim 14, wherein the inflating tube is received in an annular groove of a supporting plate of the one revolving joint unit, which supporting plate abuts against the flange.

17. The apparatus according to claim 16, wherein the supporting plate is connected sandwich-like with the one revolving joint unit by tension rods.

18. The apparatus according to claim 17, wherein the one revolving joint unit is divided into partial components, which are combined in a dividing plane disposed between two sliding surfaces facing each other.

19. The apparatus according to claim 18, wherein the tension rods also join the partial components.

20. The apparatus according to claim 11, wherein at least one of the two sliding surfaces facing each other is arranged on a flange of the one revolving joint unit, which flange is axially movable and is exposed to the influence of setting means which are axially effective for moving the flange and disposed on the one revolving joint unit, and wherein one revolving joint unit in the region of its sliding surfaces is manufactured from a metal and the other revolving joint unit in the region of its sliding surfaces is manufactured from a plastic.

21. The apparatus according to claim 20, wherein the one revolving joint unit having the flange which is axially movable is manufactured from a plastic.

22. The apparatus according to claim 21, wherein the one revolving joint unit is constructed with at least one weakening recess which facilitates axial deflectability of the flange.

23. The apparatus according to claim 1, wherein the units of the revolving joint form an annular chamber for the fluid distribution which is sealed in the region of the sliding surfaces.

24. The apparatus according to claim 23, wherein one of the units of the revolving joint forms an annular groove which is radially open and in which the other unit of the revolving joint is received.

25. The apparatus according to claim 24, wherein the annular chamber is defined radially between a bottom of the annular groove of the one revolving joint unit and a circumferential surface of the other revolving joint unit.

26. The apparatus according to claim 25, wherein the annular groove is open radially outwardly.

27. The apparatus according to claim 1, wherein one unit of the revolving joint in the region of its sliding surfaces is manufactured from a metal and the other unit of the revolving joint in the region of its sliding surfaces is manufactured from a plastic.

28. The apparatus according to claim 1, wherein there is provided a shielding wall which at least partially encloses the rotating assembly and which is stationary during the rotational operation of the rotating assembly and the revolving joint stationary unit is mounted on the shielding wall.

29. The apparatus according to claim 1, wherein the revolving joint rotating unit is drivable by means of at least one entrainment means of the rotating assembly.

30. The apparatus according to claim 1, wherein the sliding surfaces are arranged opposite each other substantially without sealing force during working operation of the rotating apparatus and are adapted to be sealingly pressed against each other for cleaning operation phases.

31. The apparatus according to claim 1, wherein the revolving joint stationary unit is annular and U-shaped in cross section and has a radially outwardly open annular groove, and the revolving joint rotating unit is an annular body which is received in the groove and has a radial fluid connection.

32. The rotating apparatus according to claim 1, wherein the revolving joint is annular.

33. The apparatus according to claim 32, wherein the revolving joint surrounds a part of the rotating assembly.

34. The apparatus according to claim 1, wherein the rotating assembly includes holding means for the objects.

35. The apparatus according to claim 1, wherein the handling devices are disposed stationary or are connected with the rotating assembly for common rotation.

36. The apparatus according to claim 1, wherein there is provided a shielding wall which at least partially encloses the rotating assembly and which is stationary during the rotational operation of the rotating assembly and the shielding wall has pass-through openings for object conveying means which convey objects to and from the rotating assembly.

37. The apparatus according to claim 1, wherein the revolving joint is disposed in an upper region of or above the rotating assembly.

38. The apparatus according to claim 1, wherein at least one of a conduit system which has at least one discharge opening and the revolving joint is adapted for retrofitting to the apparatus which is substantially ready for operation.

39. The apparatus according to claim 1, wherein at least one sliding surface of at least one of the two revolving joint units is formed on a ring plate which is elastically deformable, and the ring plate has a loading zone spaced apart radially from the sliding surface for loading by an axially directed setting force, with a supporting zone for the ring plate being provided in a further ring zone, so that by loading of the loading zone with a setting force an axial movement of the sliding surface is introduced.

40. The apparatus according to claim 39, wherein the supporting zone is provided in an intermediate zone between the sliding surface and the loading zone.

41. The apparatus according to claim 39, wherein the axial movement is opposed to the direction of the loading with the setting force.

42. The apparatus according to claim 39, wherein the elastically deformable ring plate forms with its sliding surface a limiting wall of a ring-shaped, radially open annular groove which receives the respective other revolving joint unit.

43. The apparatus according to claim 39, wherein the ring plate is supported on a ring plate carrier with formation of the supporting zone between the ring plate and the ring plate carrier and there are arranged setting means on the ring plate carrier in the region of the loading zone, which are axially effective for causing axial movement of the sliding surface.

44. The apparatus according to claim 43, wherein two ring plates are arranged on the ring plate carrier, the sliding surfaces thereof receiving the other revolving joint unit between them.

45. The apparatus according to claim 39, wherein in the absence of an external setting force the sliding surface of the ring plate is out of sealing contact with an associated countersliding surface of the other revolving joint unit and can be brought into sealing contact by introduction of an external setting force.

46. The apparatus according to claim 1, wherein the revolving joint has supply means for an assistance fluid which allows the supply of the fluid to sliding surfaces of the revolving joint, the assistance fluid being a sliding fluid, a heat carry-off fluid or a sliding and heat carry-off fluid.

47. The apparatus according to claim 46, wherein the assistance fluid is an assistance liquid.

48. The apparatus according to claim 46, wherein the assistance fluid is formed by the cleaning fluid.

49. The apparatus according to claim 46, wherein the supply of assistance fluid to the sliding surfaces is effective timewise out of cleaning periods.

50. The apparatus according to claim 49, wherein supply means are provided for the supply of the assistance fluid which are independent of the conduit system of the cleaning fluid.

* * * * *